US007938069B2

(12) United States Patent
Hu

(10) Patent No.: US 7,938,069 B2
(45) Date of Patent: May 10, 2011

(54) ADJUSTABLE BACKING PLATE STRUCTURE

(76) Inventor: Yun-Chi Hu, Taichung (TW)

( * ) Notice: Subject to any disclaimer, the term of this patent is extended or adjusted under 35 U.S.C. 154(b) by 127 days.

(21) Appl. No.: 12/013,463

(22) Filed: Jan. 13, 2008

(65) Prior Publication Data

US 2009/0178592 A1 Jul. 16, 2009

(51) Int. Cl.
*A47F 5/12* (2006.01)

(52) U.S. Cl. ..... 108/6; 108/9

(58) Field of Classification Search ..... 108/90, 108/5–7, 9, 144.11; 248/371, 393, 397
See application file for complete search history.

(56) References Cited

U.S. PATENT DOCUMENTS

| | | | | | |
|---|---|---|---|---|---|
| 2,013,542 | A * | 9/1935 | Nordmark | 108/3 |
| 2,194,889 | A * | 3/1940 | De Lisle | 108/5 |
| 2,244,391 | A * | 6/1941 | De Lisle | 33/444 |
| 2,328,471 | A * | 8/1943 | Leffel | 108/6 |
| 2,652,009 | A * | 9/1953 | Mees, Sr. | 492/14 |
| 3,094,948 | A * | 6/1963 | Clow | 108/10 |
| 4,196,674 | A * | 4/1980 | Van Laarhoven | 108/4 |
| 4,441,432 | A * | 4/1984 | Carlton | 108/5 |
| 4,592,285 | A * | 6/1986 | Egli | 108/9 |
| 4,664,039 | A * | 5/1987 | Schneider | 108/6 |
| 4,848,243 | A * | 7/1989 | Giordano | 108/9 |
| 5,174,224 | A * | 12/1992 | Nagy et al. | 108/185 |
| 6,941,876 | B1 * | 9/2005 | Traino | 108/6 |
| 7,073,449 | B2 * | 7/2006 | Pipkin | 108/44 |
| 2006/0027146 | A1 * | 2/2006 | Lee | 108/6 |
| 2008/0037213 | A1 * | 2/2008 | Haren | 361/687 |

* cited by examiner

*Primary Examiner* — Janet M Wilkens
*Assistant Examiner* — Dan Rohrhoff
(74) *Attorney, Agent, or Firm* — Muncy, Geissler, Olds & Lowe, PLLC

(57) ABSTRACT

An apparatus for supporting upon an underlying surface has an adjustable backing plate structure. The backing plate structure has a main backing plate, first and second connecting racks extending from respectively opposite sides of the main backing plate, and a supporting member connected to the first and second connecting racks. The support member is in the form of a roller and is movable between a first position extending in parallel spaced relation to an end of the main backing plate and a second position contacting a bottom surface of the main backing plate. Each of the first and second connecting racks has a locating end received in a slot of the main backing plate so as to be adjustably slidable therein.

6 Claims, 12 Drawing Sheets

ADJUSTABLE BACKING PLATE STRUCTURE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a backing plate, and more particularly to an innovative backing plate that can be adjusted with a tilt angle.

2. Description of Related Art Including Information Disclosed Under 37 CFR 1.97 and 37 CFR 1.98.

Tables are generally formed with a planar surface for secure arrangement of articles. However, if the user intends to read or write on the table, a proper tilt angle of about 17° towards the user is perfectly suitable for maintaining the uprightness and alignment of the waist of the user to guarantee the health of vertebra in the user's back.

For this reason, some table structures with adjustable table plates are developed. However, this adjustment requires the integration of turning joints, locating mechanisms, switching mechanisms and reinforced supports, leading to increases in materials and assembly costs for the users. Such adjustable table plates are generally arranged underneath the table surface, making it inconvenient to operate by users.

The other problem is that the tables without the adjustment function cannot meet the requirements of the users.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

Based on the adjustable backing plate structure A, the user could place the backing plate structure A on a table surface, changing the tilt angle or switching the horizontal level or tilt angle with the displacement of supporting member 30 to realize the desired ease-of-operation with improved applicability.

The coupling portion of the main backing plate 10 for the locating end 21 of the connecting rack 20 is provided with a long guide slot 40, and fixed by a movable locating knob 41. So, the movable locating knob 41 and long guide slot 40 are screwed tightly or loosely, so that the movable locating knob 41 may drive the connecting rack 20 to slide in the long guide slot 40, thereby adjusting the relative position of the supporting member 30 and main backing plate 10, as well as the tilt angle of the main backing plate 10.

Based on the structure of the present invention, an auxiliary pad 50 is assembled at one end of the main backing plate 10 far away from the supporting member 30. The auxiliary pad 50 is placed over or laterally onto the plate surface 11 of the main backing plate 10 to support the hands or block off articles.

There are improvements brought about by this invention.

As the supporting member 30 allows adjusting the shift distance of the main backing plate 10 on the table surface in line with the movements by the user, the main backing plate 10 could be pulled backwards and positioned to improve comfort, without the need for adjusting the tilt angle of main backing plate 10.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
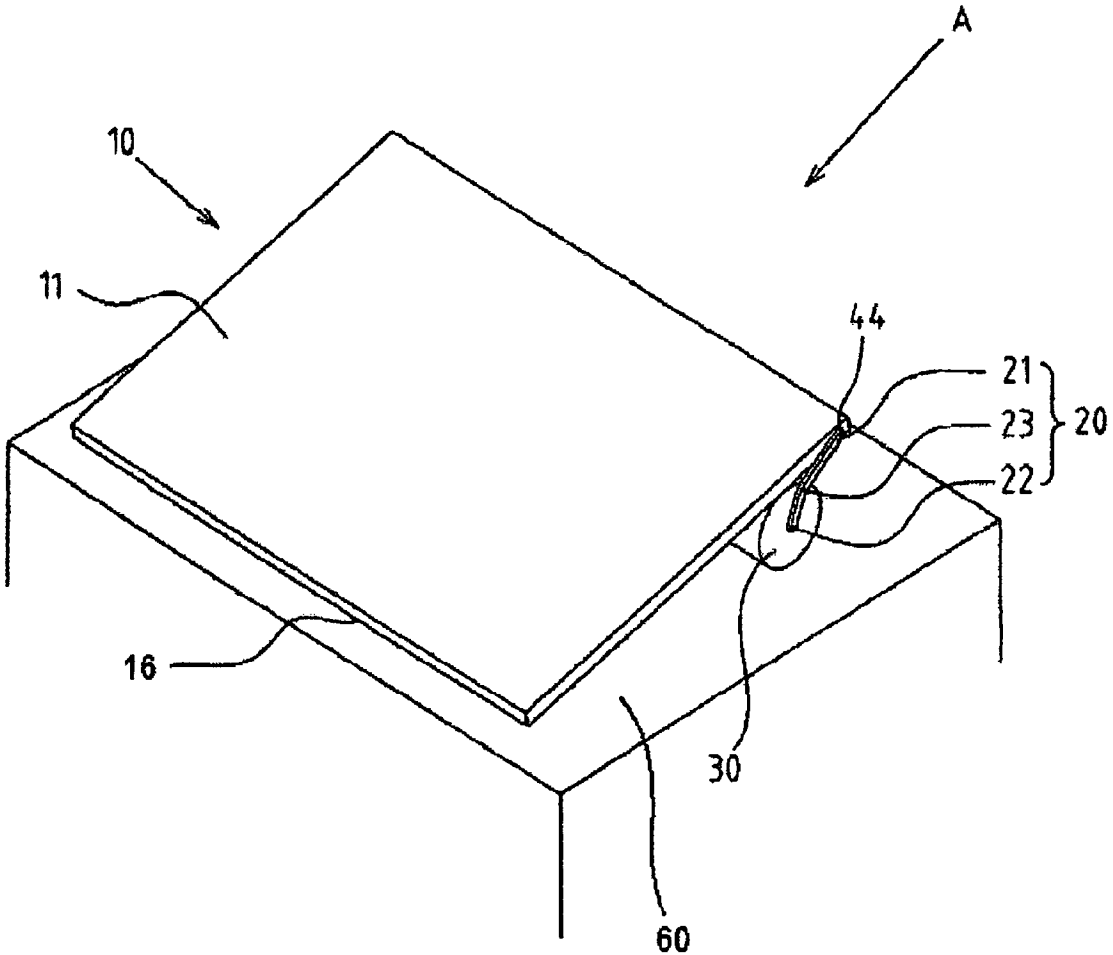
FIG. 1 shows a perspective view of the preferred embodiment of the present invention.
Figure 2:
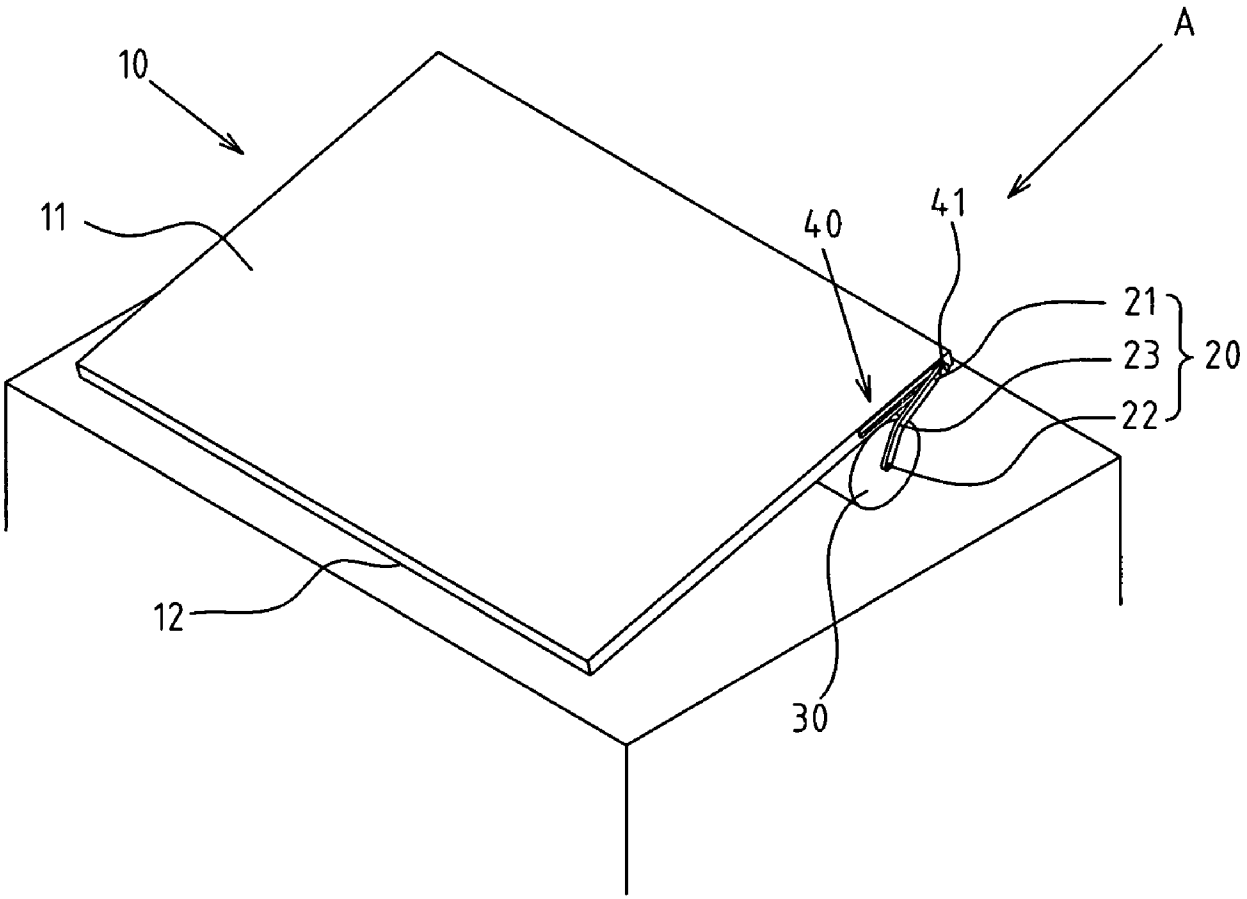
FIG. 2 shows a perspective view of the present invention.
Figure 3:
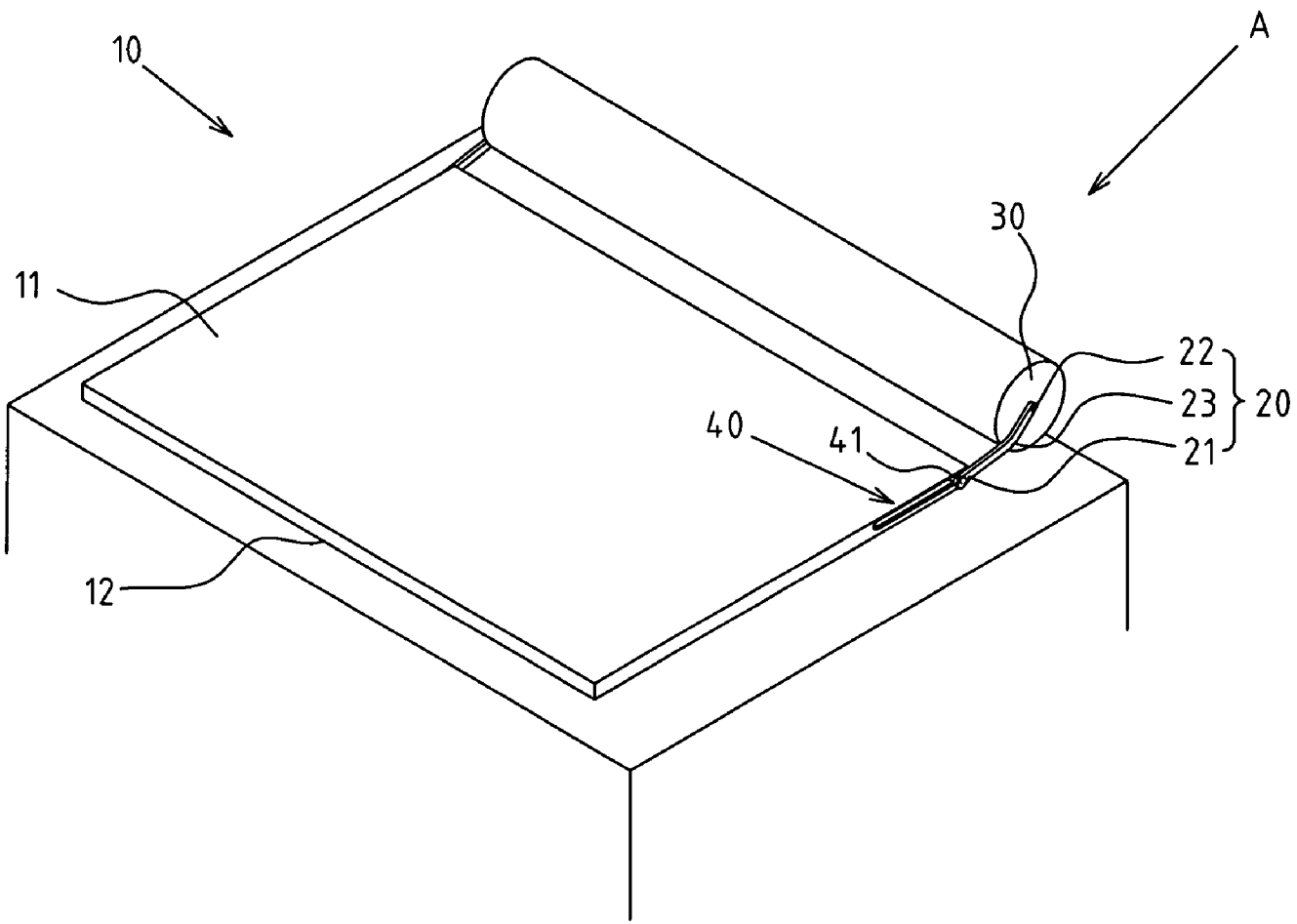
FIG. 3 shows another perspective view of the present invention.
Figure 4:
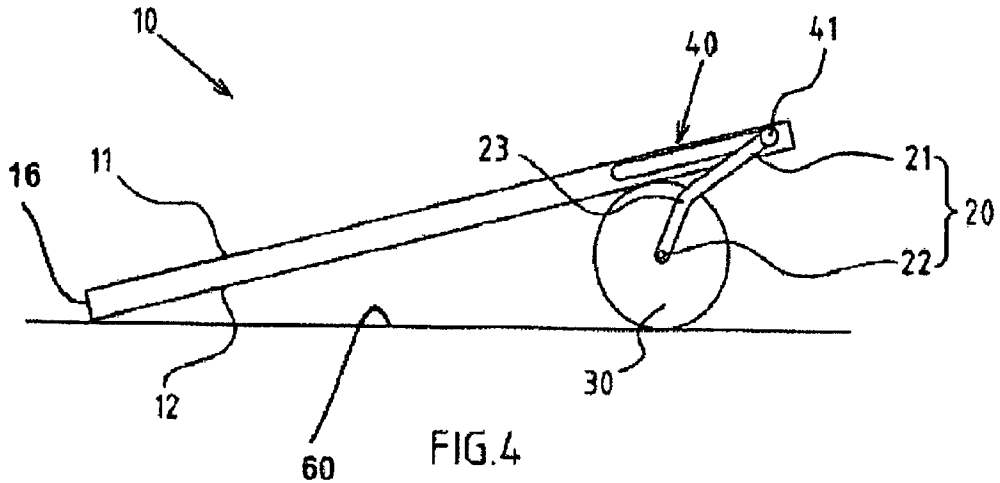
FIG. 4 shows a side elevation view of a first operation of the present invention.
Figure 5:
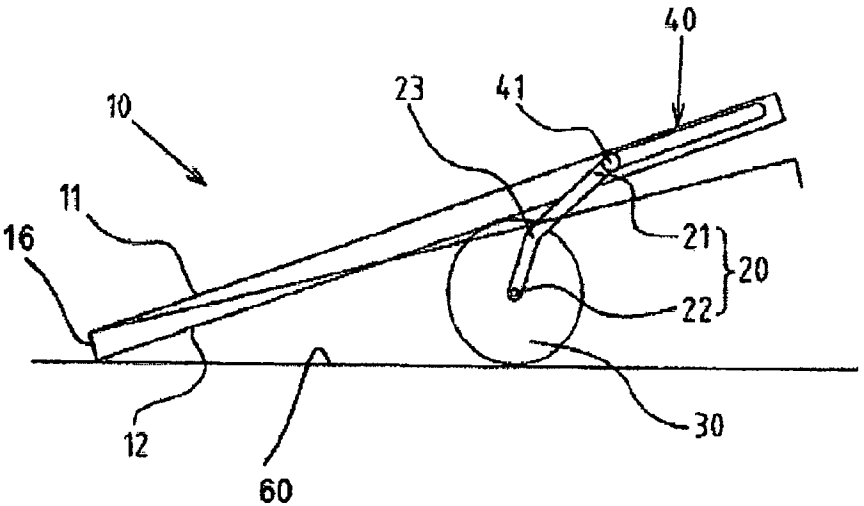
FIG. 5 shows a side elevation view of a second operation of the present invention.

The features and the advantages of the present invention will be more readily understood upon a thoughtful deliberation of the following detailed description of a preferred embodiment of the present invention with reference to the accompanying drawings.

FIGS. 1-8 depict preferred embodiments of the adjustable backing plate structure of the present invention. The embodiments are provided only for explanatory purposes with respect to the patent claims.

The adjustable backing plate structure A comprises a main backing plate 10, which is provided with a plate surface 11 and a bottom surface 12 of predefined length and thickness.

There is a connecting rack 20, including a locating end 21 and a swinging end 22. The locating end 21 is adapted to the main backing plate 10, and the swinging end 22 is extended to a predefined length.

A supporting member 30 is adapted to the swinging end 22 of connecting rack 20 for synchronous displacement. The supporting member 30 is placed either underneath or laterally on the bottom surface 12 of the main backing plate 10. The supporting member 30 will also rest on planar surface 60. The bottom side 16 of the plate 10 also movably rest on planar surface 60. The supporting member 30 is a roller.

Based upon above-specified structures, the present invention is operated as follows:

Referring to FIG. 1, this adjustable backing plate structure A permits the connecting rack 20 to be assembled at both sides of one end of the main backing plate 10. The locating end 21 of the connecting rack 20 is coupled securely with the main backing plate 10 via a fixture 44, so that the supporting member 30 of the swinging end 22 of connecting rack 20 is allowed for rolling adjustment.

Referring to FIGS. 2, 3, 4, and 5, the coupling portion of the main backing plate 10 for locating end 21 of the connecting rack 20 is provided with a long guide slot 40 and fixed by a movable locating knob 41. When the movable locating knob 41 and long guide slot 40 are adapted loosely, the movable locating knob 41 will drive the connecting rack 20 to slide in the long guide slot 40. The relative position of the supporting member 30 and main backing plate 10 are adjusted. The tilt angle of the main backing plate 10 of about 10-17° for the health of vertebra in compliance with the ergonomics is also adjustable. The connecting rack 20 comprises a foldable portion 23 to further limit the rolling and sliding of supporting member 30.

Figure 6:
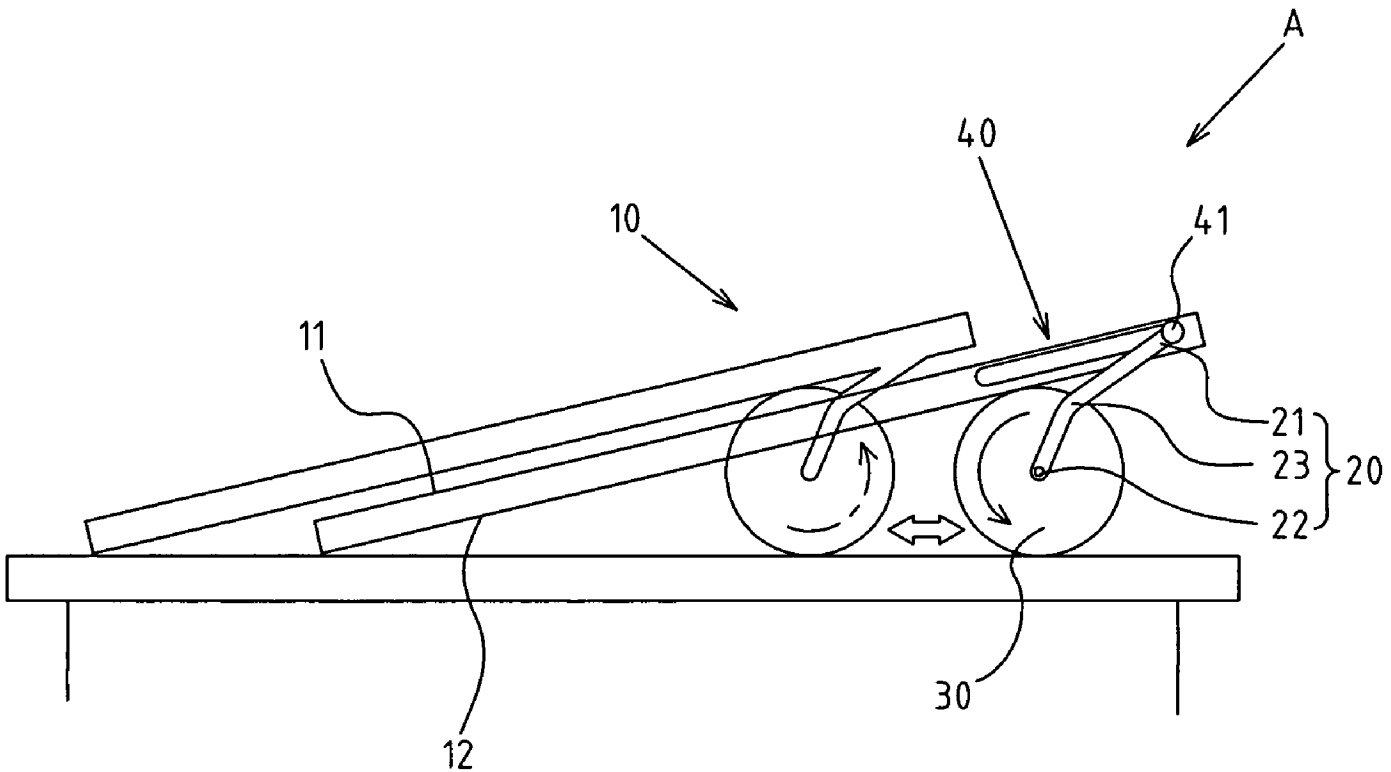
FIG. 6 shows a side elevation view of a third operation of the present invention.

Referring to FIG. 6, the adjustable backing plate structure A allows adjustment of the tilt angle of the main backing plate 10 and the shift distance of main backing plate 10 through the supporting member 30. When the user intends to sit on a chair, the main backing plate 10 is to be pulled backwards and positioned, without the need of adjusting the tilt angle of main backing plate 10.

Figure 7:
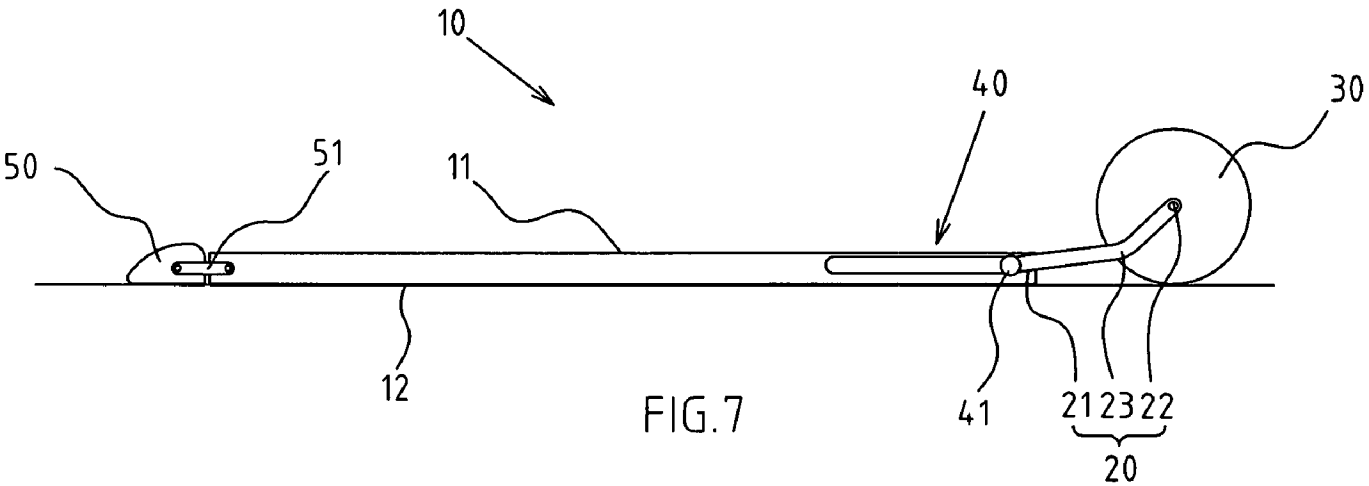
FIG. 7 shows a side schematic view of a preferred embodiment of the auxiliary pad of the present invention.
Figure 8:
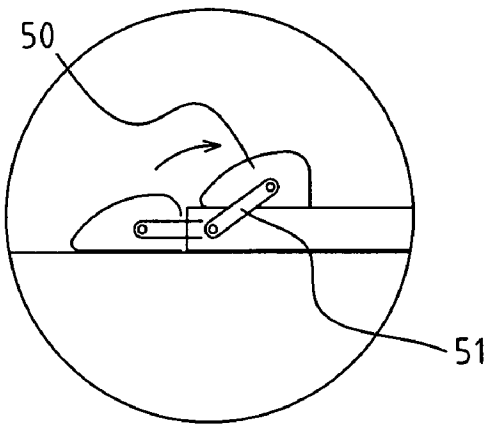
FIG. 8 shows an isolated and enlarged schematic view of the preferred embodiment of auxiliary pad of the present invention.
Figure 9:
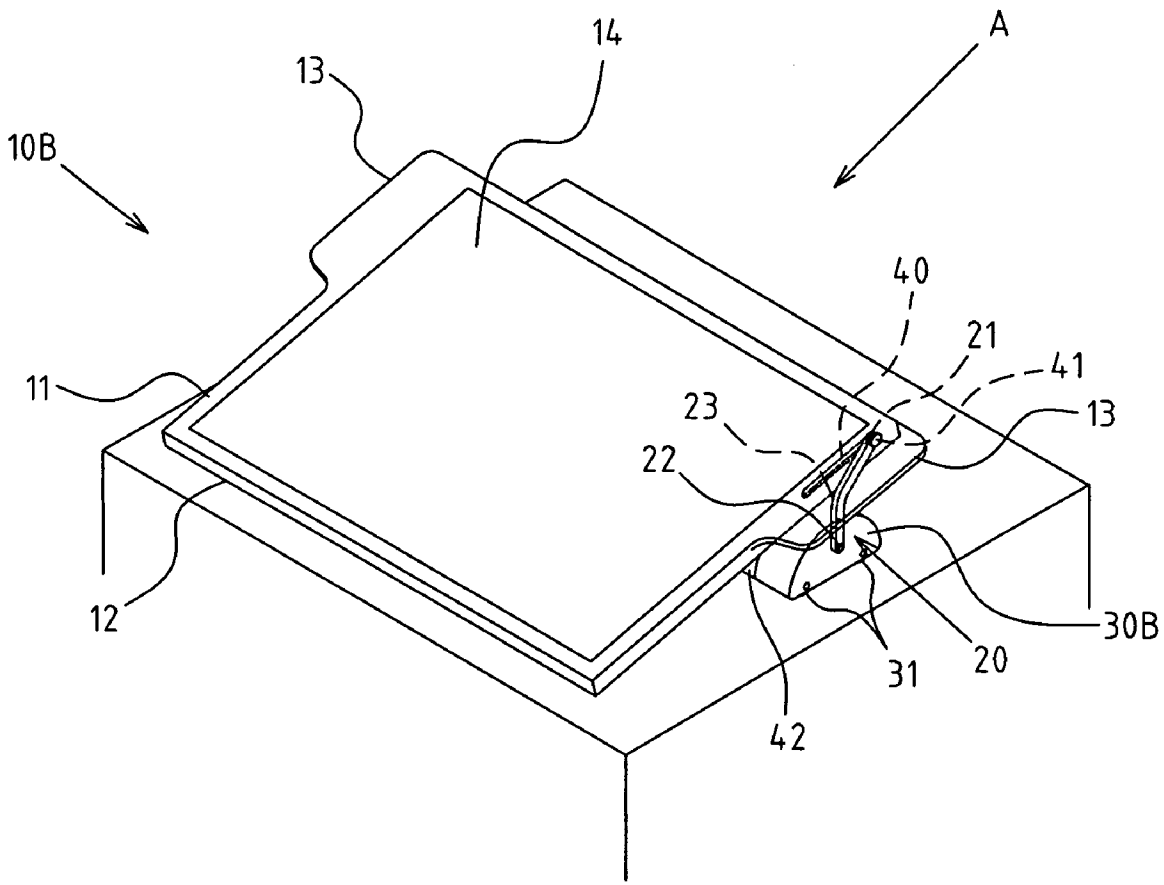
FIG. 9 shows another perspective view of a preferred embodiment of the present invention
Figure 10:
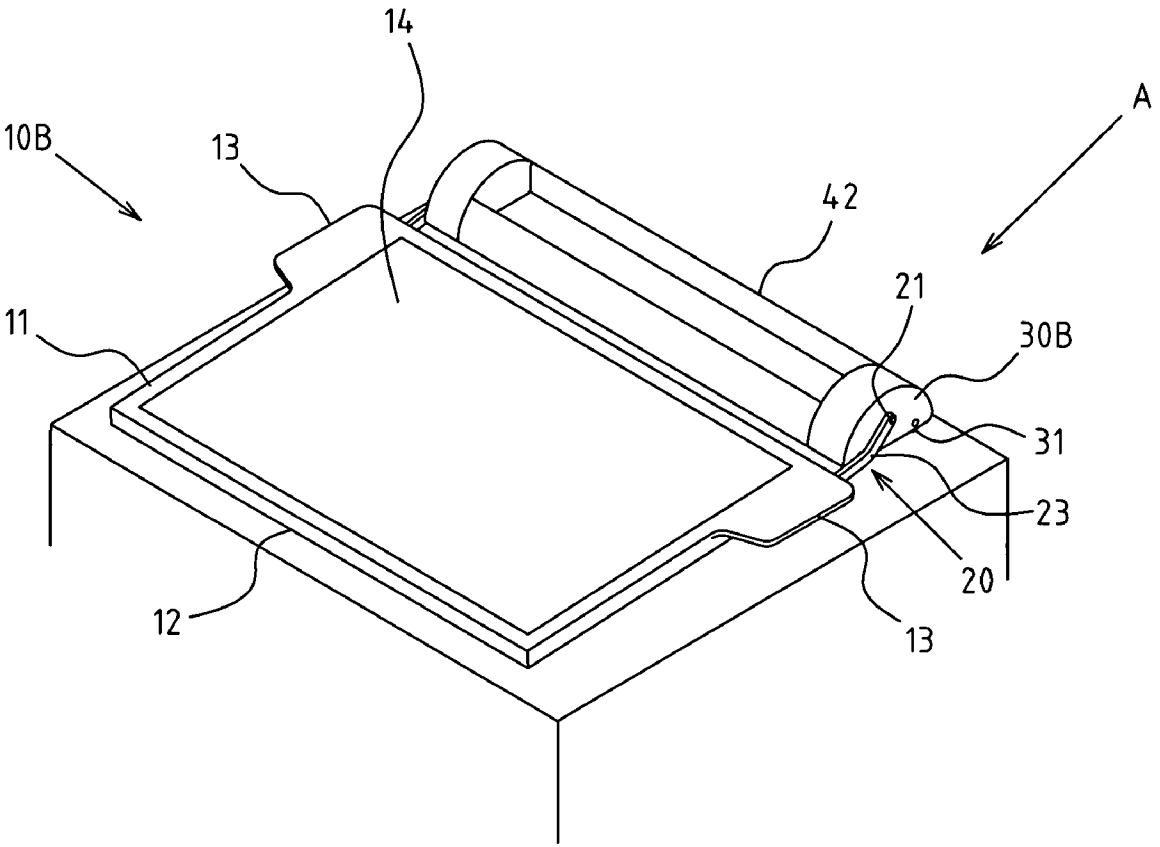
FIG. 10 shows a perspective view of the operation of the embodiment of FIG. 9.
Figure 11:
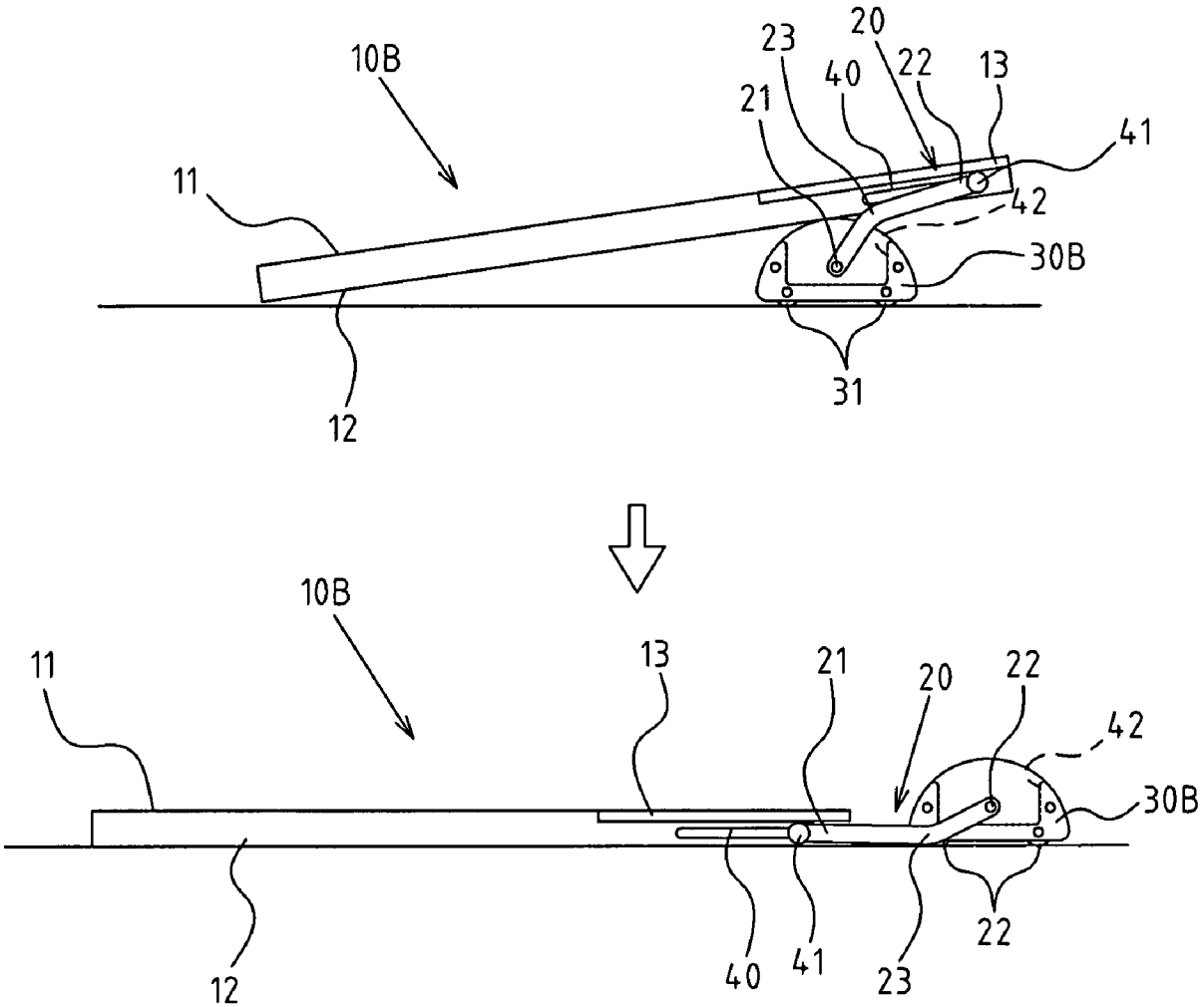
FIG. 11 shows a series of side elevation views of another preferred embodiment of the present invention.
Figure 12:
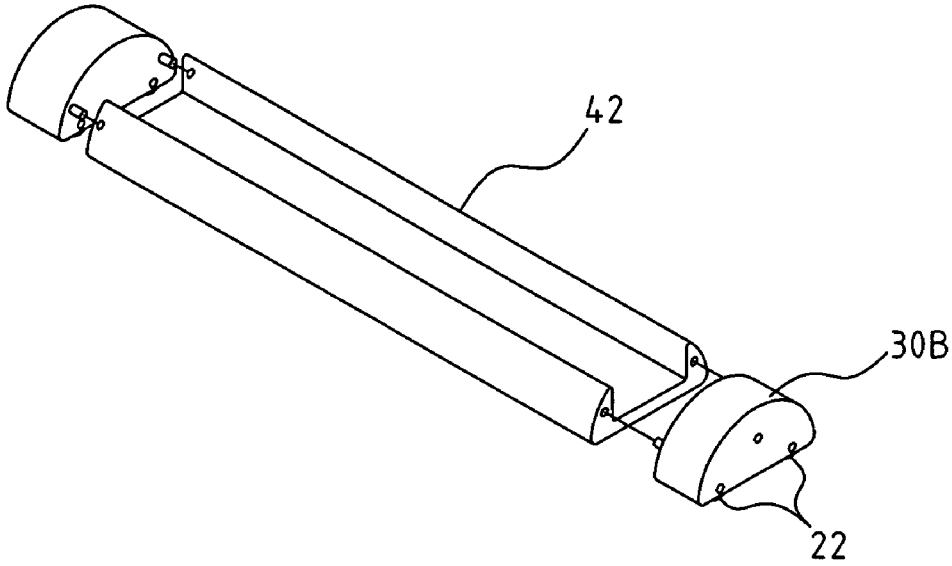
FIG. 12 shows a perspective view of a preferred embodiment of the supporting member of the present invention.
Figure 13:
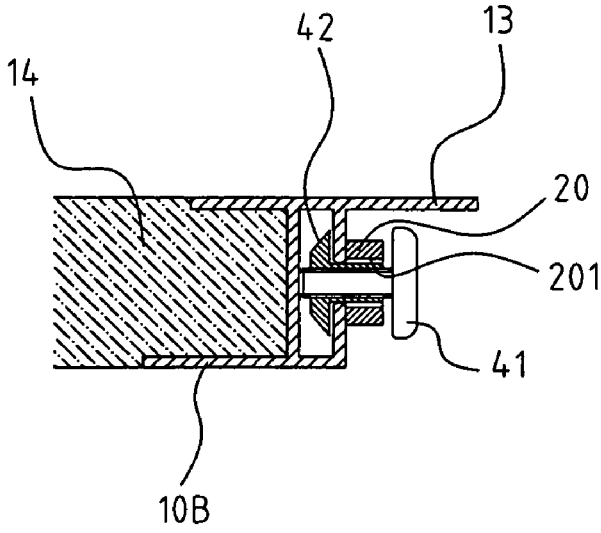
FIG. 13 shows a partially sectional view of connecting rack and main backing plate of the present invention.

Referring to FIGS. 7 and 8, an auxiliary pad 50 is placed at the other end of the main backing plate 10 and used to support the hands or block off articles. The auxiliary pad 50 is coupled with the main backing plate 10 via swinging rack 51, so that it could be placed over or laterally onto the plate surface 11 of the main backing plate 10.

Referring to FIGS. 9-13, a soft pad 14 is placed on the plate surface 11 of the main backing plate 10B, allowing the users to easily write on the plate surface 11. The supporting member 30B is a sliding support, at bottom of which a guide roller is mounted for sliding. Moreover, the sliding support is provided with a container 42 to accommodate other articles such as pencils, erasers, and rulers. A flank 13 protrudes from one end of main backing plate 10B adjacent to the long guide slot 40. When the user intends to adjust the inclined height of the main backing plate 10, the flank 13 is manually held, and the connecting rack 20 is toggled, enabling the connecting rack 20 to slide in the long guide slot 40 for adjustment purpose. The movable locating knob 41 is a pivot with bolt. A connecting rack 20 is arranged between the movable locating knob 41 and long guide slot 40. Moreover, the connecting rack 20 is also provided with a through-hole 201 for the penetration of movable locating knob 41. A movable sleeve 43 is mounted into the long guide slot 40, so that the movable locating knob 41 could be located securely in the long guide slot 40 after penetrating the movable sleeve 43.

When intended for adjustment, the user may slightly loosen the movable locating knob 41, so that the movable locating knob 41 and movable sleeve 43 slide in the long guide slot 40. Then, the movable locating knob 40 is screwed tightly for adjustment purposes.

Figure 14:
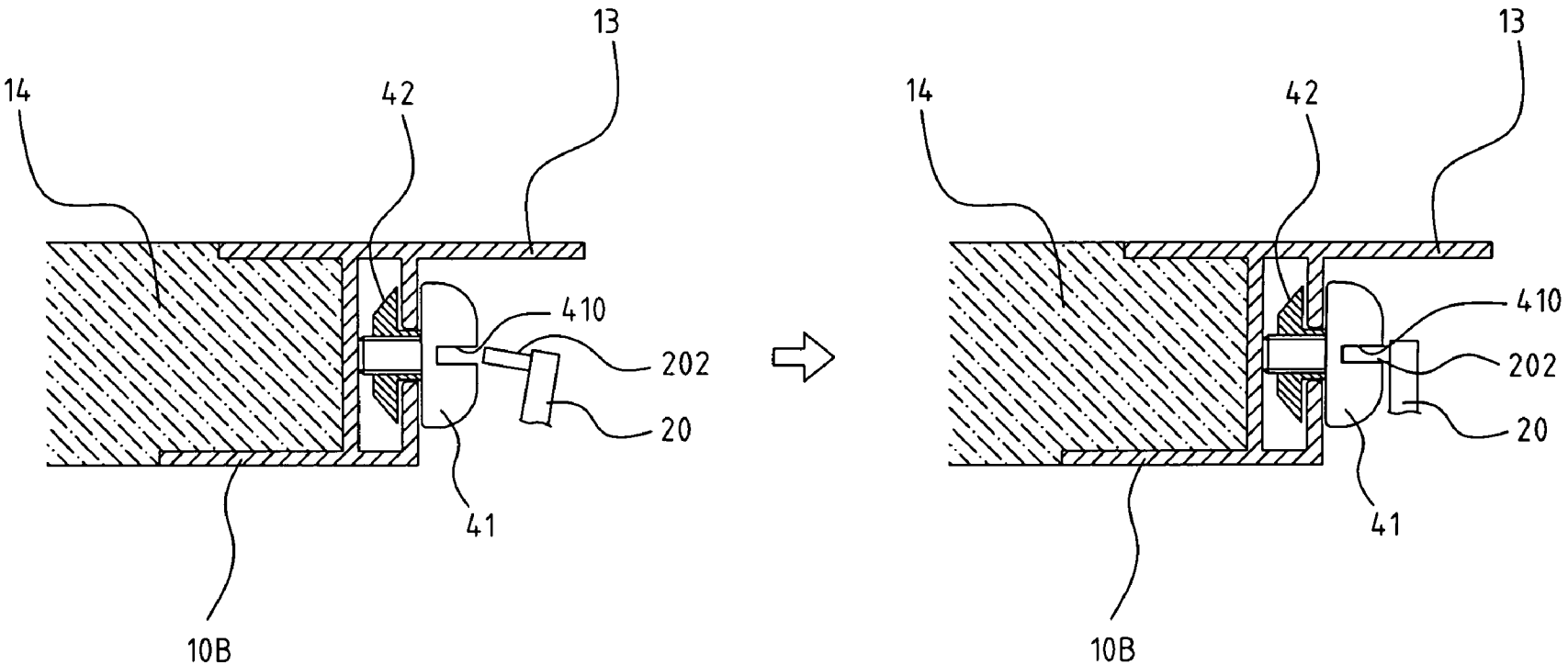
FIG. 14 shows another assembled sectional view of connecting rack and main backing plate of the present invention.

FIG. 14 depicts another preferred embodiment of the movable locating knob 41, wherein the movable locating knob 41 is provided with a groove 410, allowing insertion of an extension rod 202 at one end of the connecting rack 20. When the movable locating knob 41 is adjusted, the connecting rack 20 is driven to slide in the long guide slot 40.

Figure 16:
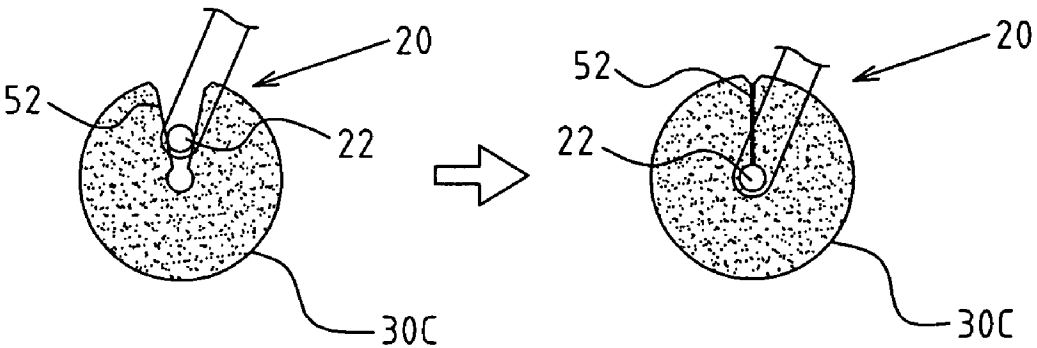
FIG. 16 shows a schematic view of the assembly of the supporting member of the present invention.
Figure 15:
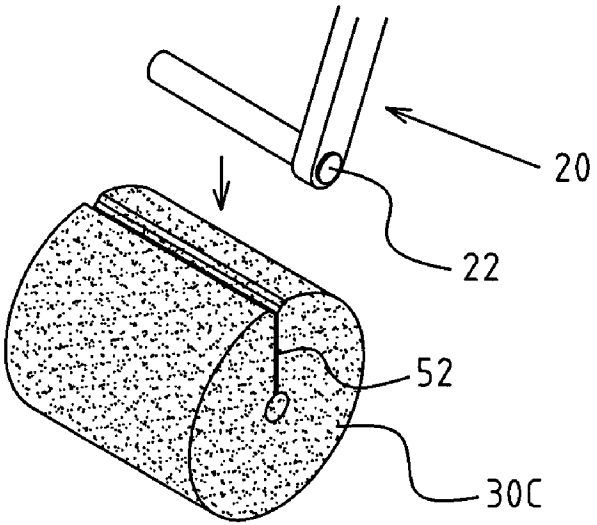
FIG. 15 shows a schematic view of another preferred embodiment of the supporting member of the present invention.

Referring to FIGS. 15 and 16, the supporting member 30C is provided with a spacing trough 52 for assembly of the connecting rack 20, making it possible to replace flexibly the materials of the supporting member 30C. If the user intends to place the adjustable backing plate structure A on the lap of the user, the supporting member 30C can be made of soft materials to prevent any pain on the legs due to pressing of blood vessel nerves.

I claim:

1. An apparatus for mounting on a planar surface, comprising:

a main backing plate having a planar upper surface and a bottom surface, said main backing plate having a first slot extending along a portion of one side thereof and a second slot extending along a portion of an opposite side thereof, wherein said main backing plate further has a bottom end, said bottom end being movably mounted to said planar surface;

a first connecting rack having a locating end pivotally connected to said first slot and a swinging end;

a second connecting rack having a locating end pivotally connected to said second slot and a swinging end;

a supporting member having a curved surface at an outer diameter thereof, said supporting member having an end connected to said swinging end of said first connecting rack and an opposite end connected to said swinging end of said second connecting rack, said supporting member and said first and second connecting racks being movable between a first position in which said supporting member extends in spaced parallel relation to an upper end, opposite to said bottom end of said main backing plate wherein the main backing plate is parallel with the planar surface and a second position in which said curved surface of said supporting member contacts said bottom surface of said main backing plate wherein the main backing plate is aligned obliquely with the planar surface.

2. The apparatus of claim 1, said supporting member being a roller, said roller having a trough formed therein.

3. The apparatus of claim 1, said locating end of said first and second connecting racks being slidable in the first and second slots.

4. The apparatus of claim 1, further comprising:

a first locating knob cooperative with said locating end of said first supporting rack and said first slot; and a second locating knob cooperative with said locating end of said second supporting rack and said second slot, said first and second locating knobs being tightenable so as to fix the locating end in the slot and loosenable so as to allow the locating end to slide to a desired position in the slot.

5. The apparatus of claim 1, further comprising:

an auxiliary pad; and a swinging rack connected to said main backing plate and to said auxiliary pad so as to be movable between a position extending outwardly of said main backing plate and a second position overlying said planar top surface of said main backing plate.

6. The apparatus of claim 1, said main backing plate having a flank mounted to said main backing plate and close to one of said one side and said opposite side.

* * * * *